United States Patent [19]

Campbell et al.

[11] 4,253,277

[45] Mar. 3, 1981

[54] TAPE DRIVE MECHANISM

[75] Inventors: Gerald J. Campbell; Stephen J. Fiordellisi, both of Warren, Mich.

[73] Assignee: General Motors Corporation, Detroit, Mich.

[21] Appl. No.: 69,982

[22] Filed: Aug. 27, 1979

[51] Int. Cl.[3] ..... E05F 11/48

[52] U.S. Cl. ..... 49/352; 49/360

[58] Field of Search ..... 49/360, 352, 325, 349

[56] References Cited

U.S. PATENT DOCUMENTS

| | | | |
|---|---|---|---|
| 3,930,339 | 1/1976 | Jander | 49/352 |
| 4,004,371 | 1/1977 | Podolan et al. | 49/352 |
| 4,109,417 | 8/1978 | Fogarollo | 49/352 |

*Primary Examiner*—Philip C. Kannan

*Attorney, Agent, or Firm*—Herbert Furman

[57] ABSTRACT

A tape drive window regulator mechanism includes a pair of track sections interconnected by a housing which mounts a rotatable roller and includes a pair of mounting sections each respective to and receiving the end of one track section. One of the track sections has its other end secured to a drive unit which moves a perforated tape through the track sections and around the roller with the tape being connected to a window drive unit for moving the window between open and closed positions.

5 Claims, 11 Drawing Figures

TAPE DRIVE MECHANISM

This invention relates generally to tape drive mechanisms and more particularly to an improved tape drive window regulator mechanism.

Tape drive window regulator mechanisms are known and are in current production usage for moving vehicle windows between open and closed positions. Generally such mechanisms include either a power or manual drive unit mounted on the inner panel of a vehicle body door and including an output cog for moving a perforated plastic tape within a generally inverted shape open track. The track generally includes a first section extending angularly upwardly from the drive unit and merging across an integral arcuate juncture into a second vertical track section. Both track sections are of generally C-shape cross-section and include a generally U-shape integral back bone or reinforcement opposite the continuous opening or slot of the track. Since the first track section generally opens downwardly of the vehicle, the second track section must open forwardly of the vehicle or to the first track section since the back bone normally permits only this type of inverted formation of the track. The vertical track section is connected to the vehicle window by a drive block unit which must encircle this track section in order to project inwardly of the open slot thereof for connection to one or more perforations of the tape.

The tape drive mechanism of this invention has several distinct features. The primary feature is that the track sections are separated and are interconnected by a housing which mounts a rotatable roller and includes a pair of mounting sections, each respective to and receiving an adjacent end of one track section. The first track section extending from the drive unit can then open downwardly of the vehicle while the vertical track section can open rearwardly of the vehicle so as to be directly connected to the drive block unit without requiring that the drive block unit encircle the track section. This obviates power losses and increases the efficiency of the drive mechanism. Additionally, by permitting the use of separate track sections, each of which open in the desired direction, the track sections may also be individually shaped as desired. Thus, for example, the first track section can be linear or transversely and/or longitudinally arcuate so as to follow the shape of the door inner panel or provide clearance. Likewise, the second vertical track section can be linear or transversely and/or longitudinally arcuate to conform to the path of movement of the vehicle window. Further, the mounting sections of the housing can be made to accept only a particular shape track section end so as to insure correct assembly of the housing to the track sections. The mounting sections are formed integrally with the housing and insure that the tape moves through the ends of the track sections tangential to the outer surface of the roller for smooth and easy operation without binding and without friction losses.

In certain installations, a heavier tape than normal is required due to the weight of the window. With the conventional track including the integral track sections joined by the integral juncture, it is difficult to use a wider tape than normal due to binding, particularly in the arcuate juncture area. The use of the roller obviates such binding in this area so as to reduce friction losses while still permitting a wider tape to be used without requiring a greater power input to move the tape. Also, if one of the track sections is of different longitudinal shape than the other, the use of an integral arcuate juncture would increase the friction losses to a high level. By forming the housing with an open one side, the tape need not completely follow the contour of the roller but can only partially overlap the roller so as to remain tangential to the roller while moving thereabout and still move smoothly and easily in the track sections even though they are offset longitudinally of the body. The roller is freely movable about a fixed axis and need not be driven since it is driven by the friction of the tape in engagement therewith.

This and other features of the tape drive mechanism of this invention will be readily apparent from the following specification and drawings wherein.

Figure 1:
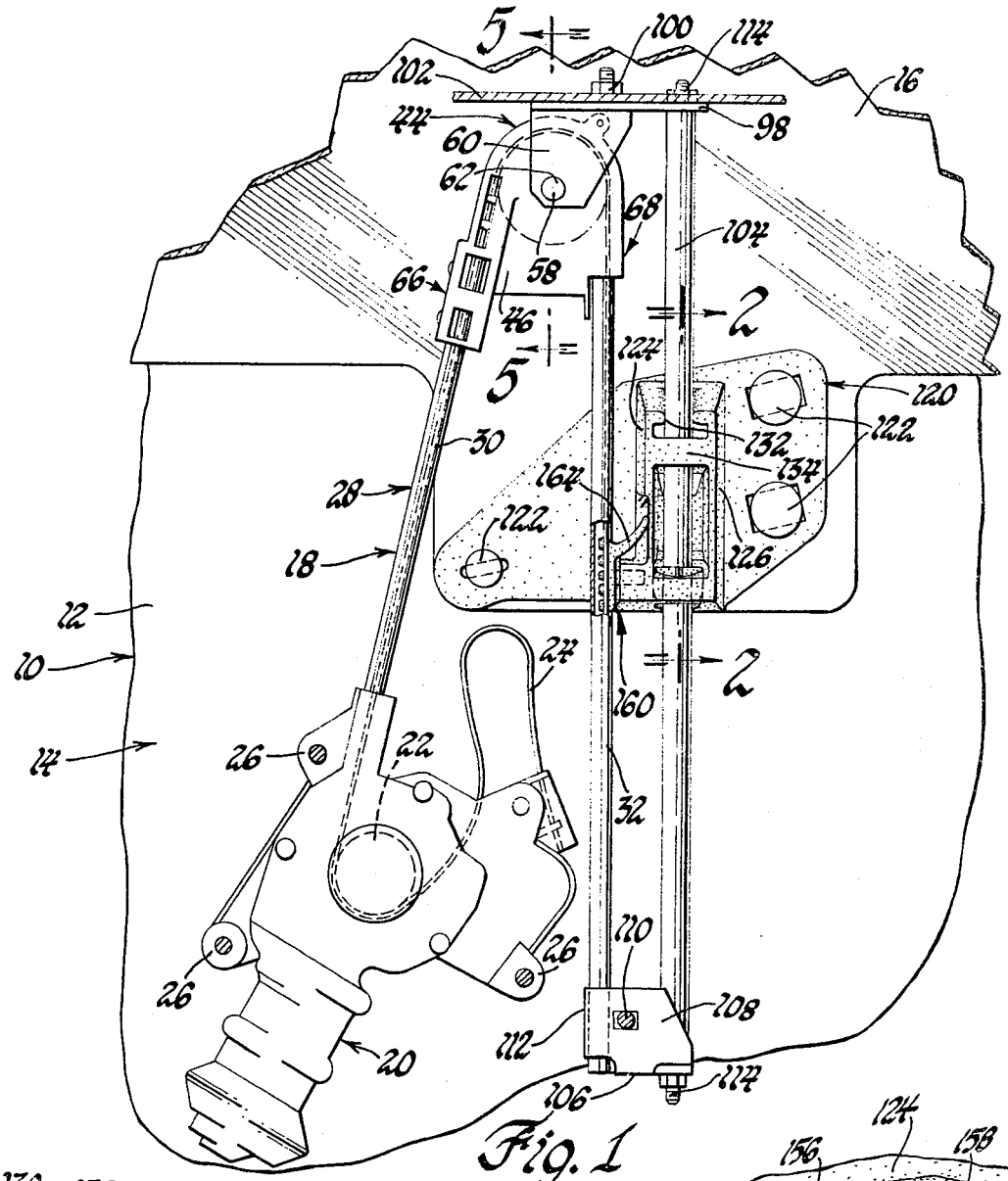
FIG. 1 is a partial view of a tape drive mechanism according to this invention installed in a vehicle body door for moving a vehicle body window between a closed position, as shown, and an open position, not shown.

Referring now particularly to FIG. 1 of the drawings, a vehicle body door designated generally 10 includes a door outer panel 12 and a door inner panel, not shown, which is spaced inboard thereof and defines therewith a window receiving well 14. A vehicle window designated generally 16 moves between a closed position, as shown, and an open position, not shown, wherein the window is located within the well 14. When the window is in closed position, it seals against a conventional upper door window frame or up against the roof rail and pillar structure of the body. Since the door 10 is conventional, further details are not necessary to an understanding of this invention.

Figure 5:
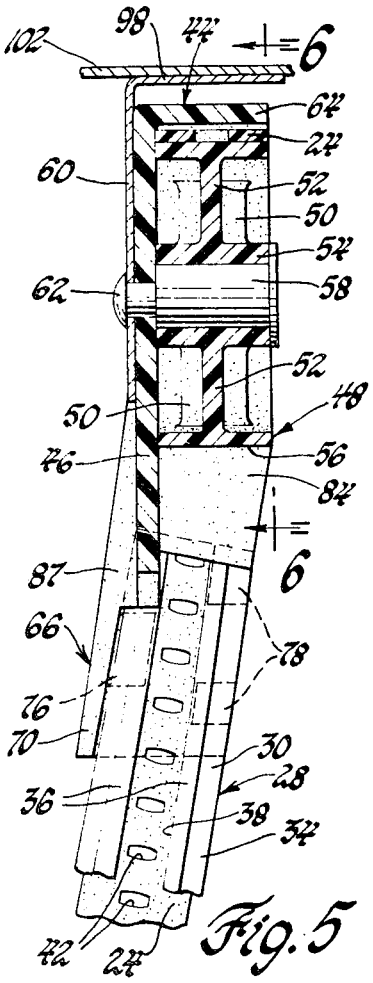
FIG. 5 is an enlarged sectional view taken generally along the plane indicated by line 5—5 of FIG. 1.

A tape drive mechanism 18 according to this invention is mounted within the well 14 and operatively connected to the window 16 for moving the window between its open and closed positions. The mechanism 18 includes a drive unit 20 which is shown as a power drive unit including a conventional electric motor and reduction gear unit driving an output cog 22 for moving a perforated tape 24 which is wider than normal. The unit 20 is a self-contained module which includes a number of mounting pads 26 seating against the door inner panel and secured thereto in a conventional manner. The tape 24 moves in a track 28 which includes a first or forward angularly extending section 30 and a second or rearward vertically extending section 32. The track 28 is of conventional structure and, as shown in FIG. 10, includes a generally C-shape body portion 34 having the reverse bent edges 36 thereof defining a longitudinally open slot 38 which is located generally opposite to a generally U-shaped reinforcement portion 40 formed integrally with the body portion. As shown, the tape 24 moves within the body portion and includes equally spaced perforations 42 which connect the tape to the output cog 22 of the drive unit and also provide for connection of the tape to the window 16 as will be described. The adjacent ends of the track sections 30 and 32 are interconnected by a housing unit 44 best shown in FIGS. 1, 5, 6, 8, and 9. The housing unit is generally integrally formed of molded plastic material and includes a planar inner wall 46 having rotatably secured thereto a roller 48. As shown in FIG. 5, the roller 48 is likewise formed of molded plastic material and includes ribs 50 and webs 52 which integrally connect the hub portion 54 of the roller with the outer tire portion 56, having a width generally the same as that of tape 24. A headed stud 58 rotatably mounts the roller 48 and in turn is fixed to wall 46 and to a mounting bracket 60 by heading over a reduced diameter portion 62 of the stud. An apertured ear 63 of wall 46 is riveted to bracket 60. The housing unit 44 further includes an integral outer peripheral wall 64 which merges into integral forward and rearward mounting sections 66 and 68 which respectively receive and mount the upper ends of track sections 30 and 32. The lower end of track section 30 is secured to unit 20 and the lower end of track section 32 is secured to door 10 in a manner to be described.

Figure 6:
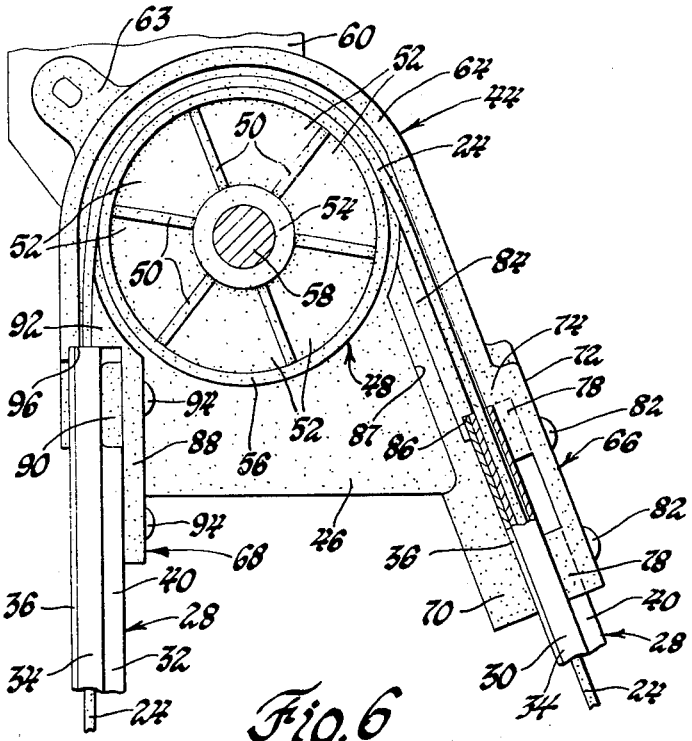
FIG. 6 is a view taken generally along the plane indicated by line 6—6 of FIG. 5.
Figure 9:
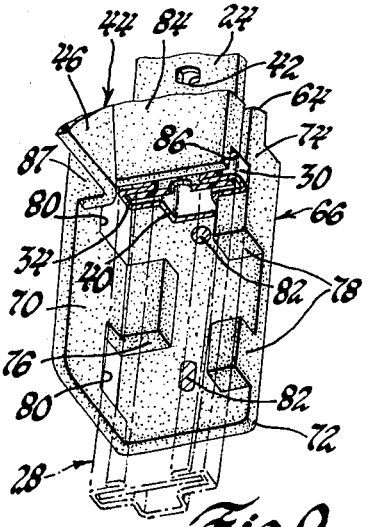
FIG. 9 is an enlarged partially broken away perspective view of a portion of FIG. 6.
Figure 10:
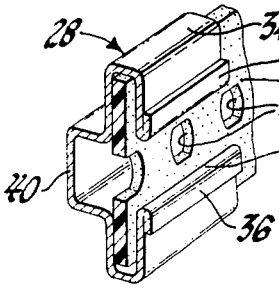
FIG. 10 is an enlarged perspective view of a portion of FIG. 1.

As shown in FIGS. 5, 6 and 9, the forward section 66 includes a slightly arcuate inner wall 70 which extends angularly to and merges into the inner wall 46 of the housing unit 44 and also into the outer peripheral wall 64 of the unit. The section 66 further includes an outer peripheral wall 72 which extends laterally to wall 70 and is joined to wall 64 by an offset thicker wall 74. An integral mounting block 76 is provided at the juncture of walls 70 and 72 and integral upper and lower mounting blocks 78 are provided at the edge of wall 64, the upper block being integral with the offset wall 74. Apertures 80 are provided in the wall 70 for manufacturing purposes. The inner side walls of the mounting blocks 76 and 78 define an open discontinuous longitudinal slot which is respective to the longitudinal shape of the reinforcement portion 40 of the track section 30 and receives such portion as shown in phantom in FIG. 9 with the base of the reinforement portion seats on wall 72 and the sides thereof seat against the inner side walls of the mounting blocks. The end edge of the reinforcement portion 40 abuts the offset wall portion 74 to thereby provide a limit stop limiting the distance of insertion of the track section 30 within mounting section 66. One or more rivets 82 secure the reinforcement portion 40 to the wall 72 to thereby fix the track section 30 to the mounting section 66. An integral rib 84 extends laterally from the wall 70 and is spaced from the wall 64 a distance slightly greater than the thickness of the tape 24 as shown in FIG. 6 to thereby cooperatively provide a guide slot for the tape 24 to ensure tangential engagement of the tape and the tire portion 56 of roller 48. The lower edge of wall 84 is cut away at 86 for engagement by the end edges of the outer legs and edges 36 of the body portion 34 of the track section, while the end edges of the inner legs of the body portion engage wall 74. Thus, the upper end of the track section 30 is positively longitudinally located within the mounting section 66 by wall 74 and cutout 86. The cutout 86 and the upper block 78 positively laterally locate the upper end of the track section 30. A lateral wall 87, FIG. 5, joins walls 70 and 46 inwardly of rib 84.

In the embodiment shown, track section 30 is longitudinally arcuate and slightly convex outboard of door 10 although laterally planar. Wall 70 conforms to the shape of the upper end portion of the track section as shown in FIG. 5 and the discontinuous slot defined by blocks 76 and 78 also conforms to the same shape, as shown in FIG. 5. Wall 72 and rib 84 conform to this shape as well. Thus, the mounting section 66 is respective to track section 30 and ensures assembly of a correctly shaped track section to the housing unit 44 as well as ensuring that the opening of the upper end of the track section is aligned with the guide slot provided by rib 84 and wall 64 to ensure tangential engagement of tape 24 and the tire portion 56 of roller 48.

Figure 8:
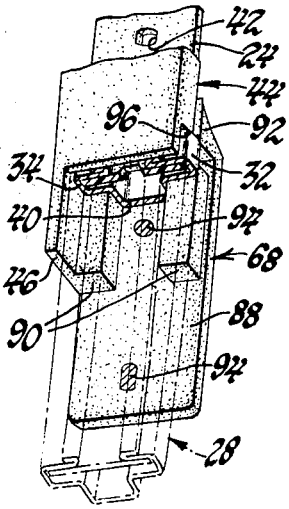
FIG. 8 is an enlarged partially broken away perspective view of a portion of FIG. 6.

The rearward mounting section 68, FIGS. 6 and 8, includes a lateral wall 88 which is formed integral with the wall 46. As shown in FIG. 8, the wall 88 includes a pair of mounting blocks 90, one being located adjacent the free edge thereof and the other being located at the juncture of wall 88 with the wall 46. A lateral rib 92 of wall 46 is integrally connected to the wall 88 and spaced from the wall 64 to provide a guide slot for the tape 24 to ensure tangential engagement of the tape and the tire portion 56 of the roller 48. The blocks 90, as shown in FIG. 8, define an open longitudinal slot which is respective to the longitudinal shape of the reinforcement portion 40 of track section 32 for receipt thereof upon insertion of the track section 32 within the mounting section 68. The reinforcement portion is secured to wall 88 by rivets 94. The track section is located relative to the wall by having the upper end edge of the reinforcement portion 40 engage the rib 92 as shown in FIG. 8, and having the end edge of the body portion engage a cut-away portion 96 of wall 64. In the specific embodiment shown, the track section 32 is laterally planar and longitudinally arcuate transversely of door 10 and conforms to the path of movement of the window 16. The mounting blocks 90 are shaped relative to each other so as to receive only a track section of this longitudinally arcuate shape.

The height of blocks 76 and 78 laterally of wall 64 and likewise the height of blocks 90 laterally of wall 88 is set such that the reinforcement portions 40 of the respective track sections engage the walls 64 and 88 while the body portions 34 seat on the blocks. This accurately positions the respective track sections relative to the respective guide slots and ensures that the tape 24 moves smoothly into and out of the track sections as well as moving smoothly into and out of tangential engagement with the tire portion 56 of the roller 48.

While both track sections are longitudinally arcuate and open in the same direction, they are misaligned longitudinally of the body. The mounting sections 66 and 68 ensure tangential engagement of tape 24 and roller 48 despite this misalignment. The tape 24 is flexible laterally of the plane thereof but rigid longitudinally in the plane thereof. Thus, depending on the shape of the track sections and the misalignment thereof, the tape 24 may completely overlap the tire portion of the roller or only partially overlap such tire portion. In either event, the tape will drive the roller 48 as it moves smoothly into and out of tangential engagement therewith and moves smoothly without binding in the track sections.

As shown in FIGS. 1 and 5, the bracket 60 includes a lateral flange 98 which overlies the housing unit 44 and is secured at one or more places 100 to a lateral wall 102 of the door inner panel.

Figure 2:
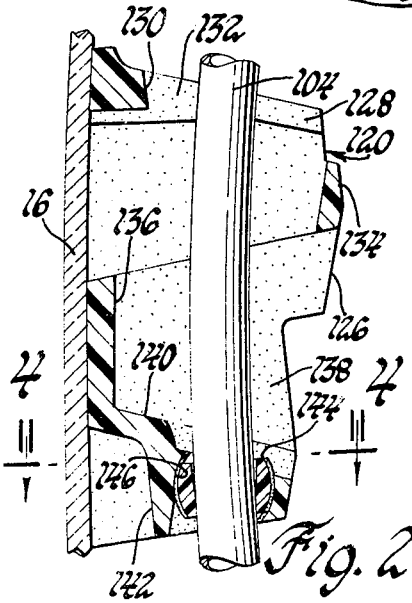
FIG. 2 is an enlarged sectional view taken generally along the plane indicated by line 2—2 of FIG. 1.

A hollow guide tube 104, FIG. 1, extends between the flange 98 and a lateral flange 106 of a lower bracket 108 which is conventionally secured to the door inner panel at 110. The lower portion of the track section 32 is welded to a lateral flange 112 of the bracket 108. The guide tube 104 is longitudinally arcuate transversely of the door 10 as shown in FIG. 2 and generally follows the path of movement of the window 16. In order to mount the guide tube to the flanges 98 and 106, a pair of ribbed plugs 114 are force fitted into the ends of the guide tube and the threaded ends thereof are bolted to the respective brackets.

A sash plate 120 of molded plastic material is conventionally secured at 122 to the window 16. The center portion of the sash plate includes a pair of generally parallel walls 124 and 126, the upper edges of which are provided with integral lateral flanges 128 joined by an integral flange 130 and defining a guide tube receiving slot 132. The walls 124 and 126 are further interconnected by webs 134 and 136.

Figure 7:
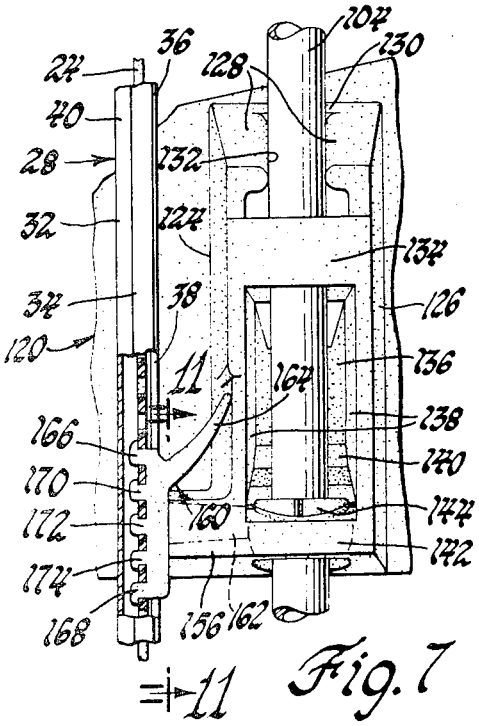
FIG. 7 is an enlarged view of a portion of FIG. 1.

The portions 138 of the walls below web 134 are thickened and taper toward each other and web 136 as shown in FIGS. 2 and 7. The portions 138 are interconnected by a lower stepped wall 140 and a bushing seat portion 142. A truncated spherical bushing 144 is seated within the bushing seat 146 of portion 142 in a manner to be described.

Figure 3:
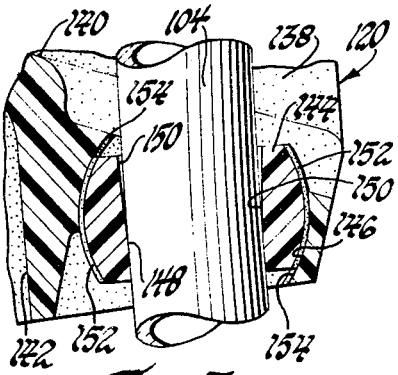
FIG. 3 is an enlarged view of a portion of FIG. 2.
Figure 4:
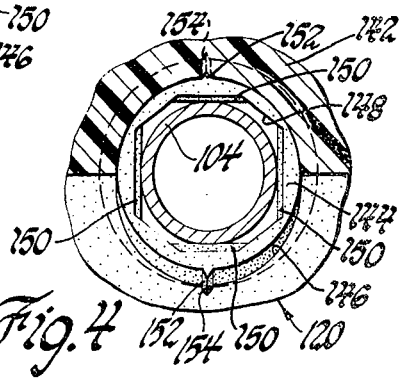
FIG. 4 is an enlarged sectional view taken generally along the plane indicated by line 4—4 of FIG. 2.

As shown in FIGS. 3 and 4, the bushing 144 includes a central octagonal shape aperture 148 having juxtaposed pairs of walls 150 thereof tapering inwardly of the bushing and toward each other for approximately one-half the vertical extent thereof. The bushing 144 is molded of suitable self-lubricating plastic material, such as nylon, and is formed in a two part mold such that the parting lines of the mold leave a pair of axial flashes or ribs 152 on the outer side thereof. The sash plate 120 is integrally molded of plastic material. The molded bushing 144 is accurately placed in the mold transverse to the plane of the sash plate before the sash plate is molded. Thus, when the sash plate is molded, the bushing is integrally molded in the sash plate, and the seat 146 of the portion 142 is thereby provided with shallow transverse grooves 154 which limit rotation of the bushing in a plane transverse of the sash plate. As shown, the guide tube 104 extends through the slot 132 and through the bushing 144. Since the sash plate is fixed to the window 16, the sash plate and window move as a unit relative to the guide tube and bushing 144 as the bushing rotates within the seat 146. The slot 132 has a width generally equal to the diameter of the guide tube and cooperates with the movement of bushing 144 within seat 146, as limited by ribs 152 and grooves 154, in ensuring that the window will follow the precise path dictated by the longitudinal curvature of the guide tube and will move laterally of the body or inwardly and outwardly as it moves between open and closed positions along this arcuate path.

The window is stabilized by the conventional sealing strips which are mounted on the door inner and outer panels at the upper opening of well 14 and slidably and frictionally engage the inner and outer surfaces of the window. Additional guides, if necessary, may also be used on the side walls of well 14, and a lateral stabilizer as shown in U.S. Ser. No. 950,629, Podolan et al, filed Oct. 12, 1978 and assigned to the assignee of this invention, may also be used.

As shown in FIGS. 3 and 4, the tapered walls 150 provide only four contact lines between bushing 144 and the guide tube 104 to reduce friction to a minimum. These lines of contact extend for approximately one-half of the depth of bushing 144 and are particularly important in permitting easy and smooth window movement under cold temperature conditions.

Figure 11:
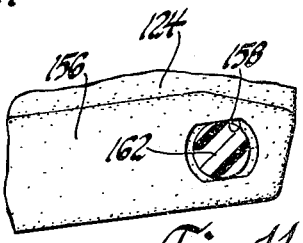
FIG. 11 is an enlarged sectional view taken generally along the plane indicated by line 11—11 of FIG. 7.

As shown in FIGS. 7 and 11, the wall 124 includes a laterally extending thickened rib 156 which is provided with an elongated opening 158 having planar upper and lower walls which taper slightly toward each other inwardly of the opening. A drive block 160 includes a slightly tapered drive pin 162 which is received within the opening 158 in tangential engagement with the upper and lower walls thereof for movement relative to such walls and inwardly and outwardly of the opening. The drive block 160 further includes an arcuately tapered finger 164 which engages the wall 124 for a purpose to be described, as well as a plurality of vertically disposed barbs which hook within the perforations 42 of tape 24 to drivingly connect tape 24 to the window 16 and sash plate 120. As best shown in FIG. 7, the vertically uppermost barb 166 faces upwardly and has the longest barb extension of any of the barbs. The vertically lowermost barb 168 faces downwardly and has a shorter barb extension than that of barb 166. The intermediate barbs 170 and 172 face upwardly while the penultimate barb 174 faces downwardly. The barbs 166 through 174 are formed integrally with the drive block 160 and hook into the perforations 42 of the tape 24 through the slotted opening 38 of the track section 32. The width of the drive block is, of course, less than the width of the opening 38 so that the drive block and tape move relative to the track section 32 without interference.

The barbs and their integral barb extensions connect the drive block to the tape and prevent the drive block from pulling out of driving connection to the tape under the various loads imposed on the drive block during movement of the window between its open and closed positions. Since the uppermost barb 166 of the drive block carries the most load, it has the longest barb extension. The lowermost barb 168 carries a lesser load and therefore has a shorter barb extension than that of barb 166. The intermediate barbs 170, 172 and 174 face oppositely of each other, but the direction in which they face and the length of their barb extensions is not critical.

During movement of the window, the guide tube 104 and the track section 32 tend to separate or move apart longitudinally of the body. The pin 162 of the drive block and the opening 158 of the sash plate permit this separation of the guide tube and the track section 32 while still maintaining a drive connection between the sash plate and tape 24. The reaction of the arcuate finger 164 against the wall 124 controls pivoting movement of the drive block relative to the sash plate in the plane of the drawings or in a plane longitudinally of the body.

It will be noted that the housing unit 44 permits the track section 32 to open directly to the guide tube so that the drive block 160 can directly connect the tape 24 and the sash plate. This reduces friction losses and increases the efficiency of the drive mechanism over known drive mechanisms wherein the track section 32 would open away from the guide tube and require the drive block to encircle the track section so as to be connected to tape 24.

Thus, this invention provides an improved tape drive mechanism.

The embodiments of the invention in which an exclusive property or privilege is claimed are defined as follows:

1. In combination with a support having a window opening, a window movable along a predetermined path between open and closed positions relative to the opening, a flexible tape for moving the window, and drive means for moving the tape, the improvement comprising, track means for guiding movement of the tape and including a pair of angularly related elongated channel track sections slidably receiving the tape and having respective adjacent ends, the track sections having longitudinally elongated openings which face in the same general direction, window drive means mounted on the window and secured to the tape through the opening of one track section, a housing located intermediate the adjacent ends of the track sections and including a rotatable roller and a pair of mounting sections, each mounting section receiving a respective track section end and including means locating the track sections with their openings facing in the same general direction and locating the adjacent ends thereof and the tape moving therethrough generally tangential to the roller, the roller guiding the tape during movement thereof between the track section ends.

2. In combination with a support having a window opening, a window movable along a predetermined path between open and closed positions relative to the opening, a flexible tape for moving the window, drive means for moving the tape, and guiding means for guiding movement of the window along the predetermined path, the improvement comprising track means for guiding movement of the tape and including a pair of angularly related elongated channel track sections slidably receiving the tape and having respective adjacent ends, one of said track sections being located generally parallel to the guiding means and having a longitudinal opening facing the guiding means, the other track section having a longitudinal opening facing in the same general direction as the opening of the one track section, window drive means mounted on the window and secured to the tape through the opening of the one track section, means slidably connecting the window drive means and the guide means, a housing located intermediate the adjacent ends of the track sections and including a rotatable roller and a pair of mounting sections, each mounting section receiving and being respective to one track section end and locating the track sections with their openings facing in the same general direction and locating the ends thereof and the tape moving therethrough generally tangential to the roller, the roller guiding the tape during movement thereof between the track section ends.

3. In combination with a support having a window opening, a window movable along a predetermined path between open and closed positions relative to the opening, a flexible tape for moving the window, and drive means for moving the tape, the improvement comprising, track means for guiding movement of the tape and including a pair of angularly related channel track sections slidably receiving the tape and having respective longitudinally misaligned adjacent end portions, window drive means mounted on the window and secured to the tape through the opening of one track section, a housing located intermediate the adjacent end portions of the track sections and including a rotatable roller and a pair of mounting sections, each mounting section receiving and being secured to a respective track section end portion and locating such track section end portion and the tape moving therethrough generally tangential to the roller, the roller permitting the longitudinal misalignment of the track section end portions while guiding the tape during movement therebetween, the housing and the roller permitting the tape to move laterally of the roller during movement thereabout, with the tape at least partially laterally overlapping the roller.

4. In combination with a support having a window opening, a window movable along a predetermined path between open and closed positions relative to the opening, a flexible tape for moving the window, and drive means for moving the tape, the improvement comprising, track means for guiding movement of the tape and including a pair of angularly related elongated track sections having respective adjacent end portions, each track section including a generally C shape channel portion slidably receiving the tape and a generally U shape longitudinal reinforcement opening thereto and to the tape, window drive means mounted on the window and secured to the tape through the opening of the channel portion of one track section, a housing located intermediate the adjacent ends of the track sections and including a rotatable roller and a pair of mounting sections, each mounting section being respective to one track section end portion and including a plurality of blocks defining a path conforming to the shape of the reinforcement of a respective track section end portion and locating the respective track section end portion and the tape moving therethrough generally tangential to the roller, the roller guiding the tape during movement thereof between the track section end portions.

5. In combination with a support having a window opening, a window movable along a predetermined path between open and closed positions relative to the opening, a flexible tape for moving the window, and drive means for moving the tape, the improvement comprising, track means for guiding movement of the tape and including a pair of angularly related elongated channel track sections slidably receiving the tape and having respective adjacent end portions, each track section having a generally U shape elongated reinforcement opening thereto and to the tape, window drive means mounted on the window and secured to the tape through the opening of the track section, a housing located intermediate the adjacent ends of the track sections and including a rotatable roller and a pair of mounting sections, each respective to one track section end portion and including a wall seating the reinforcement thereof and a plurality of blocks projecting from the wall and defining a path conforming to the longitudinal shape of the reinforcement and seating the channel track section to locate the respective track section end portion and the tape moving therethrough generally tangential to the roller, means securing each reinforcement to a respective wall, and guide means on the housing adjacent each mounting section guiding the tape tangentially to the roller, the roller guiding the tape during movement thereof between the track section end portions.

* * * * *